US010178900B2

(12) United States Patent
Izzo

(10) Patent No.: US 10,178,900 B2
(45) Date of Patent: Jan. 15, 2019

(54) JEWELRY CLASP

(71) Applicant: Vince Izzo, Palm Beach Gardens, FL (US)

(72) Inventor: Vince Izzo, Palm Beach Gardens, FL (US)

( * ) Notice: Subject to any disclaimer, the term of this patent is extended or adjusted under 35 U.S.C. 154(b) by 253 days.

(21) Appl. No.: 15/088,313

(22) Filed: Apr. 1, 2016

(65) Prior Publication Data

US 2016/0286909 A1 Oct. 6, 2016

Related U.S. Application Data

(60) Provisional application No. 62/141,540, filed on Apr. 1, 2015.

(51) Int. Cl.
*A44C 5/20* (2006.01)

(52) U.S. Cl.
CPC ..... *A44C 5/2028* (2013.01)

(58) Field of Classification Search
CPC ..... A44B 11/2592; F16B 45/04; Y10T 24/45188; Y10T 24/45403; Y10T 24/45382; Y10T 24/45366; Y10T 24/45398; Y10T 24/44615; Y10T 24/4523; Y10T 24/4544; Y10T 24/45545; A44C 5/2019; A44C 5/2023; A44C 5/2057; A44C 5/2028; B63B 21/04; F16G 11/10
USPC ..... 24/600.4, 600.8, 601.6; 63/3.1
See application file for complete search history.

(56) References Cited

U.S. PATENT DOCUMENTS

| | | | | |
|---|---|---|---|---|
| 4,566,159 | A * | 1/1986 | Leroux | A44C 5/2023 24/587.11 |
| 5,231,740 | A | 8/1993 | Mohebkhosravi | |
| 5,826,309 | A | 10/1998 | Tsamas | |
| 6,088,884 | A | 7/2000 | Hentz | |
| 7,536,757 | B2 | 5/2009 | Tan | |
| 2011/0185768 | A1 | 8/2011 | Pinchuk | |

FOREIGN PATENT DOCUMENTS

| | | | | |
|---|---|---|---|---|
| DE | 29500028 U1 * | 3/1995 | ..... | A44C 5/2023 |

* cited by examiner

*Primary Examiner* — Jack W Lavinder
(74) *Attorney, Agent, or Firm* — Global Intellectual Property Agency, LLC; Daniel Boudwin

(57) ABSTRACT

A jewelry clasp is provided that operably locks in both an open and closed state to facilitate donning of an article of jewelry and for securing the jewelry to the wearer after being donned. The clasp comprises a clasp body having a first end with a hook portion and a clearance slot. Within the clasp body is a slidable clasp member that slides within the clasp body and operably blocks and opens the clearance slot of the hook portion. Within the clasp body is a first detent and a second detent that are aligned with the slide direction of the slidable member. The slidable member includes a protrusion that operably engages the first detent and second detent. The first detent locks the clasp in an open position. The second detent locks the clasp in a closed position. Embodiments of the detents and the protrusion are provided herein.

9 Claims, 4 Drawing Sheets

JEWELRY CLASP

CROSS REFERENCE TO RELATED APPLICATION

This application claims the benefit of U.S. Provisional Application No. 62/141,540 filed on Apr. 2, 2015. The above identified patent application is herein incorporated by reference in its entirety to provide continuity of disclosure.

BACKGROUND OF THE INVENTION

Field of the Invention

The present invention relates to jewelry clasps and connectors. More specifically, the present invention relates to a new and improved jewelry clasp that is lockable in both a closed state and an open state, thereby preventing the clasp from separating when closed and facilitating donning while open.

Jewelry such as necklaces and bracelets generally employ a clasp for connecting the article of jewelry in a closed loop around the wearer. Although a wide variety of jewelry clasps are available, the most common types are bayonet clasps, lobster clasps, spring ring clasps, and conventional hook-type clasps. These common clasps suffer from known drawbacks.

First, most jewelry clasps are small and difficult to operate. Many owners struggle to operate the clasps because of their size, making them difficult to open when donning and doffing the jewelry. In addition, many conventional clasps do not satisfactory secure the jewelry article in a closed loop while being worn. This can cause the article to separate, become lost, or even become damaged if dropped. Finally, durability is a concern of most conventional clasps. Because of the necessarily small size of the clasp components required for connecting the jewelry (i.e. necklace or bracelet ends), many clasps become bent, deformed, or broken over time as the components fatigue as a result of frequent use.

While commonly jewelry clasps provide a suitable means of connecting ends of the necklace or the like, there is need for a simpler mechanism that is lockable in both an open and a closed state to improve donning and to improve security while wearing the article. The present invention provides a jewelry clasp adapted for use with common jewelry articles such as chains, bracelets, necklaces and the like. The jewelry clasp of the present invention is lockable in an open state, whereby the clasp is affixable to an opposite end of the jewelry article. In addition, the jewelry clasp of the present invention is lockable in a closed state, preventing separation while the jewelry is being worn. The present invention utilizes a clasp body with a slidable clasp member therein, whereby the slidable clasp member opens and closes a clearance slot or relief in the side of the clasp body. The slidable clasp member is lockable in both the open and closed state using a detent along the claps body and protrusion along the slidable clasp member.

SUMMARY OF THE INVENTION

The following summary is intended solely for the benefit of the reader and is not intended to be limiting in any way. The present invention provides a new jewelry clasp that can be utilized for securing an article of jewelry while being worn and for facilitating doffing of the jewelry article.

It is therefore an object of the present invention to provide a new and improved jewelry clasp device that has all of the advantages of the prior art and none of the disadvantages.

It is another object of the present invention to provide a jewelry clasp device that comprises a clasp body and a slidable clasp member therein. The slidable clasp member is positionable in an open and closed state, whereby the member is operably locked to the clasp body in those states to improve security and facilitate connection of the clasp with an end of an article of jewelry.

Another object of the present invention is to provide a jewelry clasp device whereby the clasp body has a first end, a second end, and an interior. The first end of the clasp body has a hook portion and a clearance slot, whereby the hook portion has an interior that forms an aperture through the clasp body. The clearance slot is disposed along an edge of the clasp body and is adapted to provide access to the interior of the hook portion when connecting an end of a jewelry article to the clasp.

Another object of the present invention is to provide a jewelry clasp device whereby the slidable clasp member is slidably disposed within the interior of the clasp body. The slidable clasp member has a slide direction therein, an open position, and a closed position.

Another object of the present invention is to provide a jewelry clasp device whereby the clasp body has a first detent and a second detent along the interior thereof, whereby the first detent and the second detent are aligned with one another along the slide direction of the slidable clasp member.

Another object of the present invention is to provide a jewelry clasp device whereby the slidable clasp member has a length, a first end, and a second end. The slidable clasp member further comprises a protrusion extending outward therefrom along its length that is adapted to removably engage the first detent and the second detent to lock the slidable clasp member in the open and close state, respectively.

Another object of the present invention is to provide a jewelry clasp device wherein the slidable clasp member is in the open position when the protrusion is engaging the first detent and in the closed position when the protrusion is engaging the second detent.

Another object of the present invention is to provide a jewelry clasp device wherein the first end of the slidable clasp member secures over the clearance slot when the slidable clasp member is in the closed position. Additionally, the clearance slot of the clasp body is open to the interior of the hook portion of the clasp body when the slidable clasp member is in the open position.

Another object of the present invention is to provide a jewelry clasp device wherein the first end of the slidable clasp member is adapted to be received within the first end of the clasp body when the slidable clasp member is moved into the closed position.

Another object of the present invention is to provide a jewelry clasp device wherein the first end of the slidable clasp member further comprises a smaller hook portion with an interior. The slidable clap member further comprises a clearance slot disposed along an edge thereof that is adapted to provide access to the interior of the smaller hook portion. The clearance slot of the slidable clasp member aligns with the clearance slot of the clasp body when the slidable clasp member is in the open position.

Another object of the present invention is to provide a jewelry clasp device wherein the first detent and the second detent of the clasp body further comprise notches along an interior surface of the clasp body.

Another object of the present invention is to provide a jewelry clasp device wherein the first detent further comprises a notch along an interior surface of the clasp body and the second detent further comprises an edge of the clearance slot of the clasp body.

Another object of the present invention is to provide a jewelry clasp device wherein the slidable clasp member further comprises a hollow interior and an inner spring bar along one side thereof. The inner spring bar comprises an elastically deformable length of material along the side of the slidable clasp member, whereby the inner spring bar supports the protrusion and bears against an interior surface of the clasp body to removably engage the protrusion with first detent and the second detent of the clasp body as the slidable clasp member moves between the open position and the closed position.

Another object of the present invention is to provide a jewelry clasp device wherein the protrusion further comprises a curved portion along an end of the inner spring bar.

Another object of the present invention is to provide a jewelry clasp device wherein the protrusion further comprises a rounded end along an end of the inner spring bar.

Another object of the present invention is to provide a jewelry clasp device wherein the protrusion further comprises a rounded tab on the slidable clasp member.

Another object of the present invention is to provide a jewelry clasp device wherein the second end of the clasp body further comprising an elongated tang that can be formed into a closed loop.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows an assembly view of the jewelry clasp of the present invention, whereby the clasp is in a closed position and is engaging a jewelry hoop.

FIG. 2A provides a view of the first end of the jewelry clasp with the clasp in an open position.

FIG. 2B provides a view of the first end of the jewelry clasp with the clasp in a closed position.

DETAILED DESCRIPTION OF THE INVENTION

Figure 1:
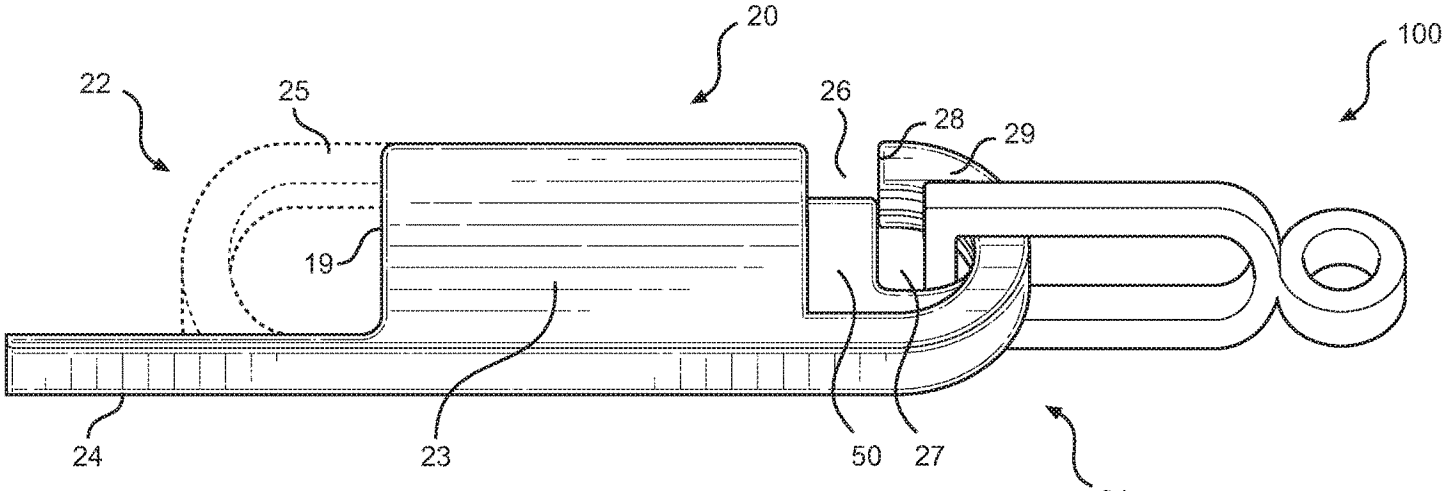

Reference is made herein to the attached drawings. Like reference numerals are used throughout the drawings to depict like or similar elements of the jewelry clasp of the present invention. For the purposes of presenting a brief and clear description of the present invention, the preferred embodiment will be discussed as used for providing a jewelry clasp having a slidable member that is operably lockable in an open and closed state. The figures are intended for representative purposes only and should not be considered to be limiting in any respect.

Referring now to FIG. 1, there is shown a view of the jewelry clasp of the present invention in a working state. The jewelry clasp is one that is adapted to secure two ends of an article of jewelry together and secure the jewelry while being worn. The clasp has an open position and a closed position, both of which are lockable such that the wearer can more easily don the jewelry and also prevent separation while the jewelry is being worn. The clasp comprises a clasp body 20 and a slidable clasp member 50 disposed therein. The slidable clasp member 50 is slidable within the clasp body 20 and operably opens and closes the clasp when slid from a first position to a second position.

The clasp body 20 forms the exterior of the jewelry clasp and houses the slidable clasp member 50 therein. The clasp body 20 has a body portion 23, a first end 21, a second end 22, and an interior. The slidable clasp member 50 is disposed within the interior of the clasp body 20. The first end 21 of the clasp body 20 further comprising a hook portion 29 and a clearance slot 26 disposed between the hook end 28 and the sidewall of the clasp body 20. The clearance slot 26 is disposed along a side or an edge of the clasp body 20, and is adapted to provide access to the interior 27 of the hook portion 29 for retaining jewelry loops 100 and other jewelry ends. The hook portion 29 has an interior 27 and forms an aperture through the clasp body 23, within which a closed loop 100 of a jewelry end can be retained.

Figure 2B:
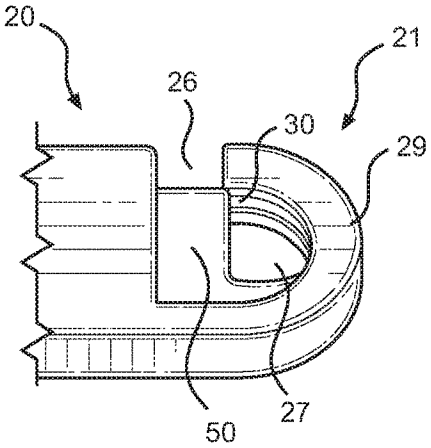
Figure 2A:
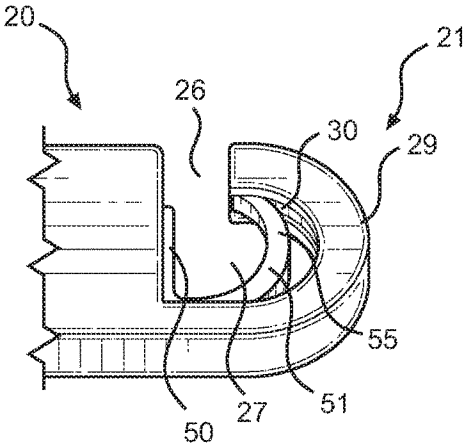

Referring to FIGS. 2A and 2B, the open and closed position of the slidable clasp member 50 is shown. The slidable clasp member 50 is slidably disposed within the interior of the clasp body 20. The slidable clasp member 50 has a slide direction, an open position (FIG. 2A), and a closed position (FIG. 2B). In addition, the slidable clasp member 50 has a length, a first end 51, and a second end. The first end 51 of the slidable clasp member 50 is adapted to be received within the first end 21 of the clasp body 20. When the slidable clasp member 50 is in the closed position, slidable clasp member 50 secures over the clearance slot 26 of the clasp body 20 and the interior 27 of the hook portion 29 is enclosed (FIG. 2B). The slidable clasp member 50 may further comprise a smaller hook portion 55 that is adapted to be received within the first end 21 of the clasp body 20. Furthermore, the first end 21 of the clasp body 20 may comprise a channel 30 that accepts the smaller hook portion 55 of the slidable clasp member 50 therein when the slidable clasp member 50 is in its closed position. Finally, when the slidable clasp member 50 is in an open position, the clearance slot 26 of the clasp body 20 is open to the interior of the hook portion 27.

Figure 3:
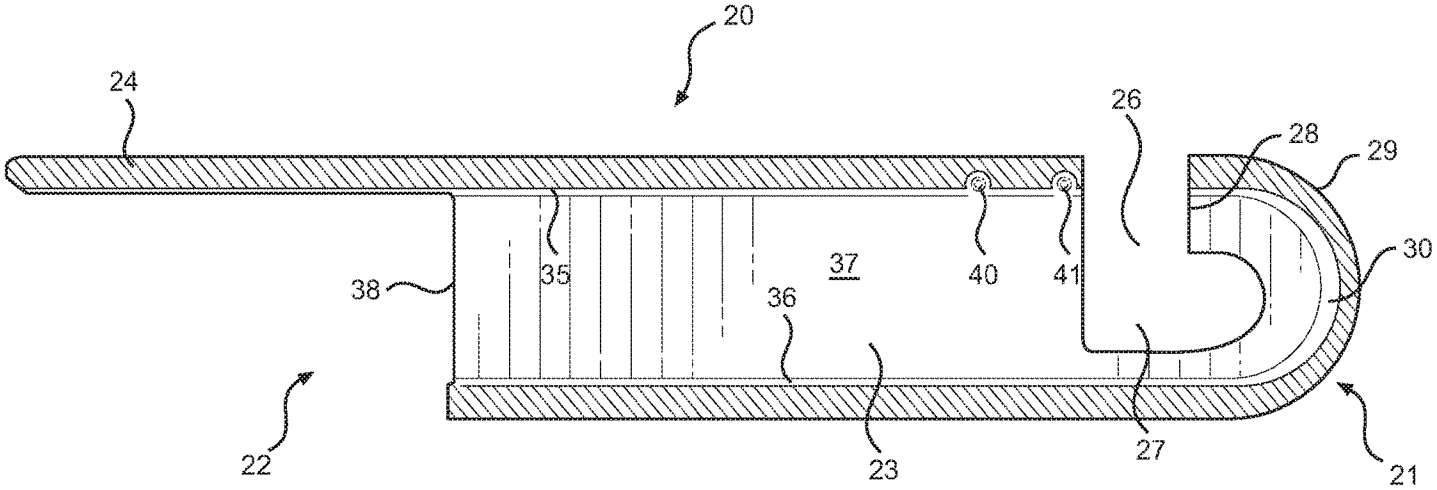
FIG. 3 shows a side view cross section of the clasp body.
Figure 4:
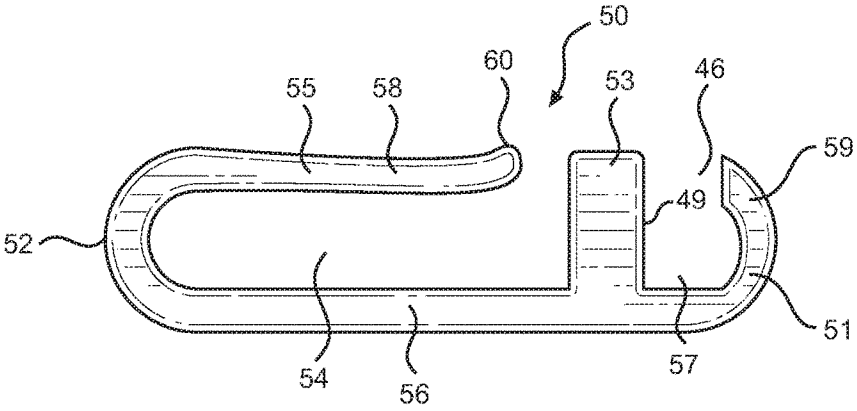
FIG. 4 shows a side view of an embodiment of the slidable clasp member.

Referring now to FIGS. 3 and 4, there are shown cross section views of the clasp body 20 and the slidable clasp member 50. The clasp body 20 is a substantially hollow member with a first end 21, second end 22, and a body portion 23. Within the body portion 23 is an open interior adapted to support the slidable clasp member 50 therein. The interior of the clasp body is bounded by sidewalls 37, an upper surface 35, and a lower surface 36. In one embodiment, the sidewalls 37 form the long major surfaces and the upper and lower surfaces form minor surfaces, whereby the clasp body 20 comprises a substantially rectangular shape and enough clearance to support the substantially planar slidable member 50.

The first end 21 of the clasp body 20 comprises a hook portion 29 and a clearance slot 26. The clearance slot 26 is disposed along an edge of the clasp body and is adapted to provide access to the open interior 27 of the hook portion 29. This allows closed-loop jewelry ends to be inserted through the clearance slot 26 and into the open interior 27 of the hook portion 29. The slidable clasp member functions by operably opening and closing the clearance slot 26 based on its position within the clasp body 20.

The slidable clasp member 50 has a slide direction along the length of the clasp body. That is, sliding between the first end 21 and second end 22 thereof. The slidable clasp member 50 further comprises having a length, a first end 51, and a second end 52. Along the length of the slidable clasp member 50 is a protrusion 60, which is used to operably engage one of two detents 40, 41 along the interior of the clasp body 20. The protrusion 60 has several embodiments, and comprises a tab, tang, or similar projection from the body of the slidable clasp member 50 that can engage the detents 40, 41 of the clasp body 20. The detents preferably comprise depressions, channels, or notches along the interior surface of the clasp body 20, whereby the protrusion 60 structure inserts into the particular detent as the protrusion is positioned thereover.

The detents 40, 41 are preferably aligned with the slide direction of the slidable clasp member 50 such that the protrusion can engage each detent as the member 50 is slid within the clasp body 20. The detent secures the protrusion 60, thereby locking the slidable clasp member 50 in a static state until the user forcibly moves the slidable clasp member 50 and the protrusion 60 withdraws from the detent. The slidable clasp member 50 may have a smaller hook portion 59, an interior edge 49, and an open interior 57 that is adapted to align with the open interior 27 of the clasp body. To facilitate sliding the slidable clasp member 50 and freeing the protrusion 60 from the particular detent 40, 41, the user can insert the closed end of a jewelry article within the aligned open interiors 27, 57 of the assembly and pull on the jewelry article. The jewelry article bearing against the interior of the smaller hook portion 59 or the interior edge 49 acts to slide the slidable clasp member 50 and free the protrusion 60 from the particular detent 40, 41.

Several embodiments of the protrusion are provided herein. In one embodiment as shown in FIG. 4, the slidable clasp member 50 comprises an open interior 54, a first side 56, and a second side 58. The sides bear against the upper 35 and lower 36 surfaces of the clasp body as the slidable clasp member translates therein. Along the second side 58 of the slidable clasp member 50 is an inner spring bar 55. The end of the inner spring bar 55 extends outward from the slidable clasp member body to form the protrusion 60. The inner spring bar 55 in turn is an elastically deformable length of material along the side of the slidable clasp member 50 that is capable of deforming inward within the open interior 54 of the member and springing outward to force the protrusion 60 into the particular detent 40, 41. The protrusion 60 is positioned outboard of the side of the member 50, therefore causing the protrusion to bear against an inner surface of the clasp body 20 while sliding therealong. When a detent is reached the protrusion 60 is biased into the detent by the inner spring bar 55. When forcibly removed from the detent, the inner spring bar is forced inward and sliding of the member 50 is accommodated.

The slidable clasp member 50 further comprises a body portion 53 that is adapted to secure over the clearance slot 26 of the clasp body when the member 50 is in a closed position. The body portion 53 may extend along a substantial length of the slidable clasp member 50, or may be a mid-body structure that extends between the sides 58, 56 as shown in FIG. 4. In this embodiment, the inner spring bar 55 is elongated and the open interior 54 extends along a majority of the member's length.

Figure 5A:
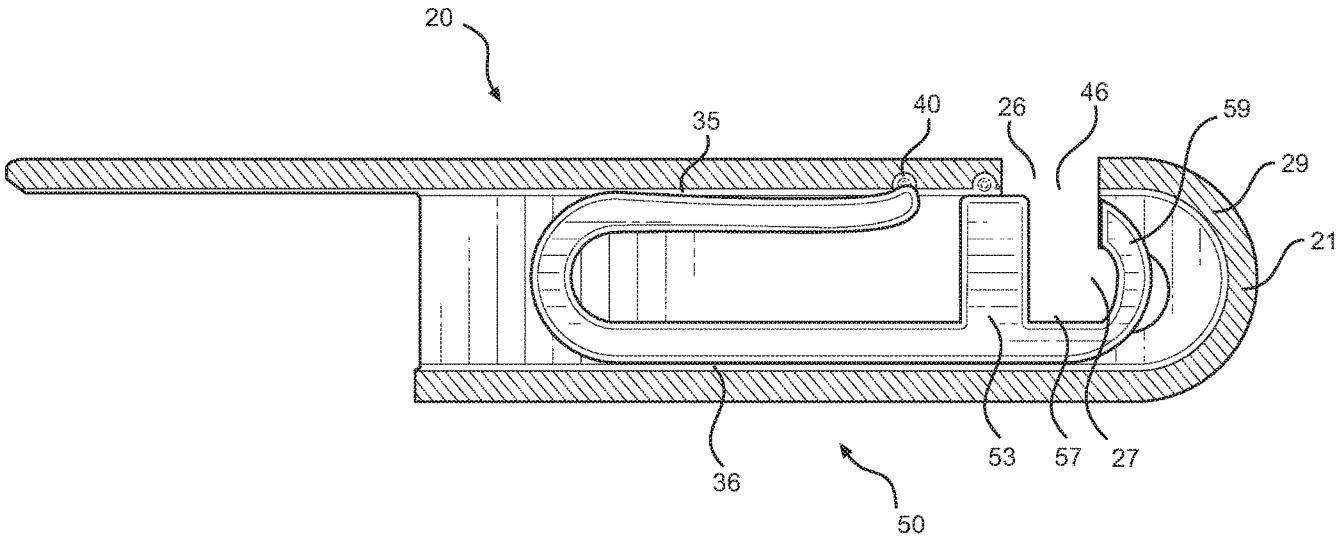
FIG. 5A shows a side view cross section of the clasp body and slidable clasp member in an open state.
Figure 5B:
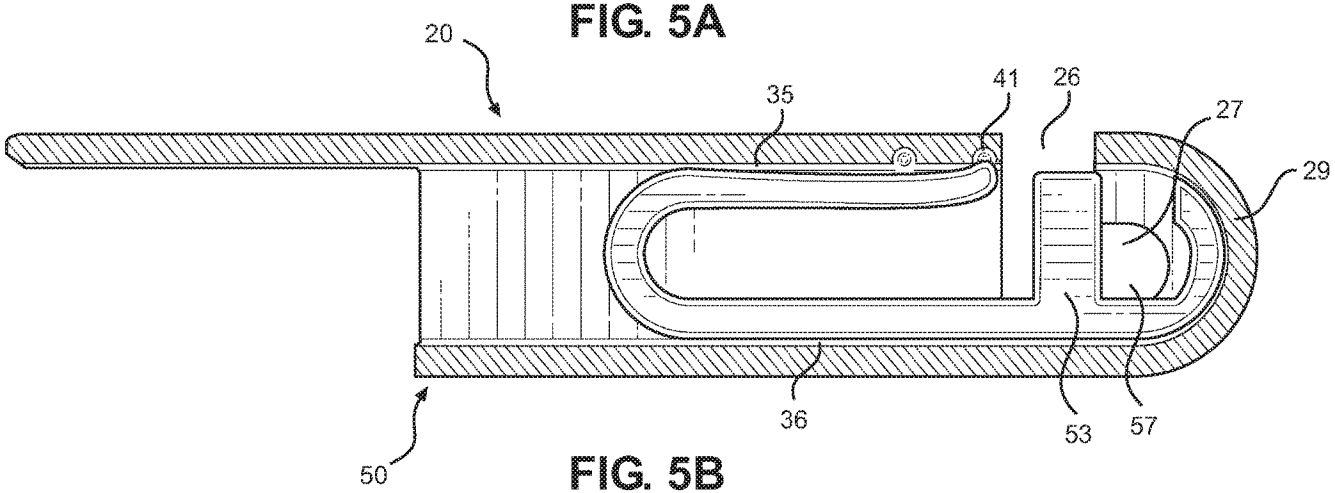
FIG. 5B shows a side view cross section of the clasp body and slidable clasp member in a closed state.

FIGS. 5A and 5B show the slidable clasp member 50 disposed within the interior of the clasp body 20, and furthermore shows the open position and closed position, respectively. The protrusion 60 of the slidable clasp member 50 is an outwardly directed end of the inner spring bar 55, whereby the end engages the first 40 and second 41 detents to lock the member 50 in the open or closed position. In the open position, the protrusion 60 is engaged within the first detent 40. The body portion 53 of the member 50 is withdrawn into the interior of the clasp body such that the clearance slot 26 of the clasp body 20 aligns with the clearance slot 46 of the member 50. The open interiors 27, 57 of the clasp body 20 and member 50 are also aligned, whereby a closed loop jewelry end can be inserted through the aligned slots 26, 46 and into the aligned open interiors 27, 57.

When closing the clasp, the user can pull the closed loop jewelry end toward the first end 21 of the clasp body 20 and draw the slidable clasp member 50 towards the hook portion 29. The smaller hook portion 59 of the member 50 allows the closed loop jewelry end to bear thereagainst, tensioning the slidable member 50 and withdrawing the protrusion 60 from the first detent 40. When the slidable member 50 is fully slid into the hook portion 29, the protrusion 60 engages the second detent 41 and locks in place. The body 53 of the member 50 is position over the clearance slot 26 of the clasp body 20 and the jewelry end is secured within the first end 21 of the clasp 20. Similarly, to open the clasp, the user tensions the jewelry end against the body 53 of the slidable member 50, thereby causing the protrusion 60 to withdraw from the second detent 41 and slide into the clasp body 20 until the first detent 40 is reached. At this point, the body 53 of the member 50 is withdrawn into the interior of the clasp body 20, and the clearance slot 26 is exposed to the interior 27 of the clasp body hook end 29. These operations allow the clasp to operably lock in both the open and closed positions.

Figure 6A:
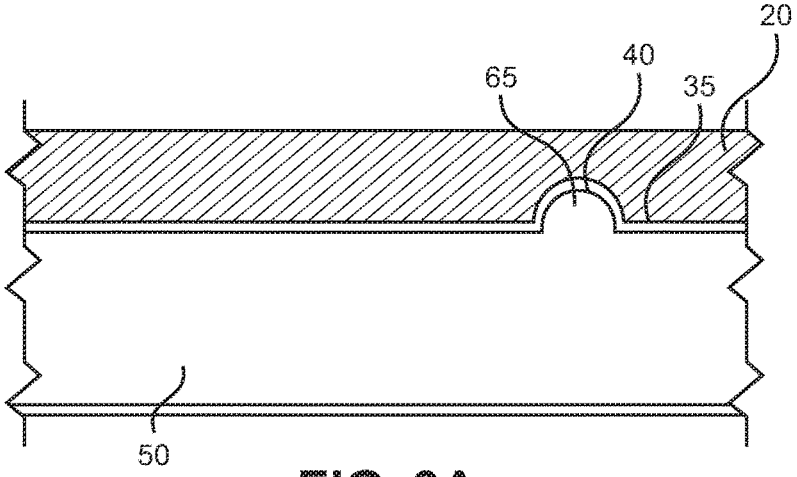
FIG. 6A shows an embodiment of the protrusion and detent of the clasp.
Figure 6B:
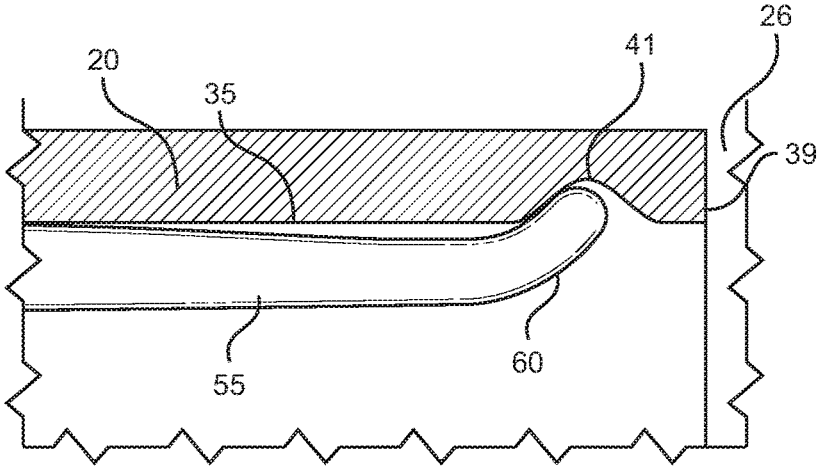
FIG. 6B shows another embodiment of the protrusion and detent of the clasp.
Figure 6C:
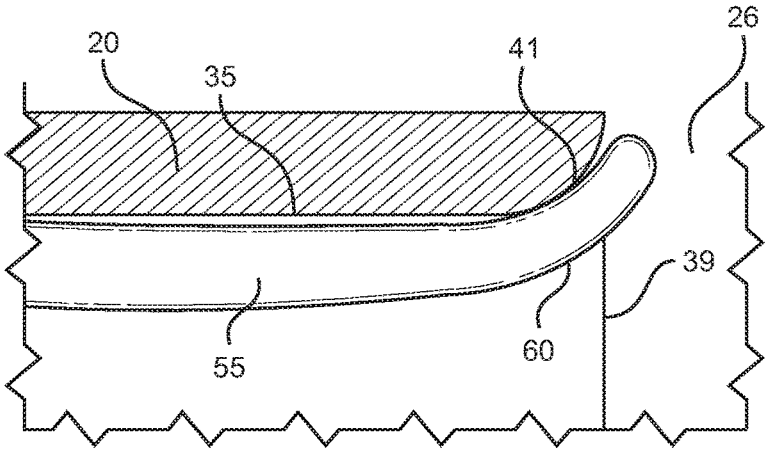
FIG. 6C shows another embodiment of the protrusion and detent of the clasp.

Referring now to FIGS. 6A, 6B, and 6C, several embodiments of the protrusion and detent are provided. In one embodiment shown in FIG. 6A, the detents 40 further comprise notches, channels, or similar concave depressions within the interior surface 35 of the clasp body 20. Along the sides of slidable clasp member 50 is a complimentary tab 65 or similar convex protrusion that is adapted to be received within the concave depression of the clasp body. In this configuration, the clasp body 20 preferably has a first and second concave depression and the slidable clasp member has a single convex protrusion. The connection between the particular depression and the protrusion will depend on the slidable position of the member 50 within the clasp body 20.

In another embodiment as shown in FIGS. 6B and 6C, the protrusion 60 comprises an extended end of the inner spring bar 55. The inner spring bar 55 comprises elastically deformable length with a distal end that extends outward from the slidable member 50. The distal end forms the protrusion from the slidable member 50 that engages the detents of the clasp body. In turn, the detents of the clasp body may comprise a pair of concave depressions, or one concave depression and one curved end 45 of the slidable member. In the former embodiment, first detent and the second detent share the same construction. The second detent 41, as shown in FIG. 6B, comprises a concave depression within the side 35 of the clasp body. The protrusion 60 engages the second detent 41 before the clearance slot 26 of the clasp body and before the edge 39 of the clearance slot. In the latter embodiment, and as shown in FIG. 6C, the edge 39 of the clearance slot 26 may form the second detent. The edge 39 may comprise a radius 45 against which the protrusion 60 (either a tab or the distal end of the inner spring bar) bears against. In this embodiment, the protrusion 60 extends slightly into the clearance slot 26 and the radius 45 resists sliding motion to open the clasp until sufficient force is applied by the user to disengage the protrusion 60 from the radius and slide the slidable member 50 towards the open position.

Therefore, the pair of detents and the protrusions may take on different structures, falling within the scope of providing a means to operatively secure the slidable clasp member within the clasp body in the open and closed positions. The detents are concave structures or a radius along the clearance slot of the clasp body, while the protrusion is a convex structure along the side of the slidable clasp member. In use, the clasp remains open when in the open position, and remains closed when in the closed position. The size of the protrusion, the detents, and the spring stiffness of the inner spring bar will determine the amount of force required to release the protrusion from the detents and thus move the slidable clasp member between the open and closed positions. The ability to lock the clasp in the open state assists connecting jewelry ends to the clasp, while the ability to lock the clasp in a closed state prevents the jewelry from separating once connected.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jewelry clasp, comprising:

a clasp body having a first end, a second end, and an interior;

the first end of the clasp body further comprising a hook portion and a clearance slot;

the hook portion having an interior that forms an aperture through the clasp body;

wherein the clearance slot is disposed along an edge of the clasp body and is adapted to provide access to the interior of the hook portion;

a slidable clasp member that is slidably disposed within the interior of the clasp body;

the slidable clasp member having a slide direction, an open position, and a closed position;

a first detent and a second detent along the interior of the clasp body, the first detent and the second detent being aligned with one another along the slide direction of the slidable clasp member;

the slidable clasp member having a length, a first end, and a second end;

wherein a protrusion extending outward from the slidable clasp member along its length is adapted to removably engage the first detent and the second detent;

wherein the slidable clasp member is in the open position when the protrusion is engaging the first detent and in the closed position when the protrusion is engaging the second detent;

wherein the first end of the slidable clasp member secures over the clearance slot when the slidable clasp member is in the closed position;

wherein the first detent further comprises a notch along an interior surface of the clasp body;

wherein the second detent further comprises an edge of the clearance slot of the clasp body;

wherein the clearance slot of the clasp body is open to the interior of the hook portion when the slidable clasp member is in the open position.

2. The jewelry clasp of claim 1, wherein:

the first end of the slidable clasp member is adapted to be received within the first end of the clasp body;

wherein the first end of the slidable clasp member further comprises a smaller hook portion with an interior;

the slidable clasp member further comprises a clearance slot disposed along an edge thereof that is adapted to provide access to the interior of the smaller hook portion;

wherein the clearance slot of the slidable clasp member aligns with the clearance slot of the clasp body when the slidable clasp member is in the open position.

3. The jewelry clasp of claim 1, wherein:

the first detent and the second detent further comprise notches along an interior surface of the clasp body.

4. The jewelry clasp of claim 1, wherein:

the first detent and the second detent further comprise concave depressions along an interior surface of the clasp body.

5. The jewelry clasp of claim 1, wherein:

the slidable clasp member further comprises a hollow interior and an inner spring bar along one side thereof;

wherein the inner spring bar comprises an elastically deformable length of material along the one side of the slidable clasp member, whereby the inner spring bar supports the protrusion and bears against an interior surface of the clasp body to removably engage the protrusion with first detent and the second detent of the clasp body as the slidable clasp member moves between the open position and the closed position.

6. The jewelry clasp of claim 5, wherein the protrusion further comprises an outwardly curved portion along a distal end of the inner spring bar.

7. The jewelry clasp of claim 5, wherein the protrusion further comprises a distal end of the inner spring bar.

8. The jewelry clasp of claim 5, wherein the protrusion further comprises a rounded tab along the inner spring bar.

9. The jewelry clasp of claim 5, wherein the protrusion further comprises a convex member along the inner spring bar.

* * * * *